US010787329B2

(12) United States Patent
Sugawara et al.

(10) Patent No.: US 10,787,329 B2
(45) Date of Patent: Sep. 29, 2020

(54) SHEET FEEDING DEVICE, IMAGE FORMING APPARATUS, IMAGE FORMING SYSTEM, AND SHEET PROCESSING APPARATUS

(71) Applicants: Tatsuya Sugawara, Kanagawa (JP); Hideaki Takahashi, Kanagawa (JP); Hikaru Fukasawa, Kanagawa (JP)

(72) Inventors: Tatsuya Sugawara, Kanagawa (JP); Hideaki Takahashi, Kanagawa (JP); Hikaru Fukasawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 4 days.

(21) Appl. No.: 16/233,359

(22) Filed: Dec. 27, 2018

(65) Prior Publication Data

US 2019/0202647 A1 Jul. 4, 2019

(30) Foreign Application Priority Data

Dec. 28, 2017 (JP) ..... 2017-254510
Aug. 1, 2018 (JP) ..... 2018-145287

(51) Int. Cl.
*B65H 1/14* (2006.01)
*B65H 3/48* (2006.01)
(Continued)

(52) U.S. Cl.
CPC ..... *B65H 1/14* (2013.01); *B65H 1/04* (2013.01); *B65H 3/128* (2013.01); *B65H 3/48* (2013.01);
(Continued)

(58) Field of Classification Search
CPC ... B65H 1/08; B65H 1/14; B65H 1/18; B65H 3/047; B65H 3/128; B65H 3/48;
(Continued)

(56) References Cited

U.S. PATENT DOCUMENTS 9,926,157 B2 * 3/2018 Sugawara ..... B65H 3/128
2005/0067759 A1 * 3/2005 Koga ..... B65H 1/14 271/126
(Continued)

FOREIGN PATENT DOCUMENTS

JP 2014-156310 8/2014
JP 2016-078975 5/2016
(Continued)

*Primary Examiner* — Prasad V Gokhale
(74) *Attorney, Agent, or Firm* — Harness, Dickey & Pierce, P.L.C.

(57) ABSTRACT

A sheet feeding device includes a sheet stacker configured to stack a sheet bundle; a blower configured to float a sheet on an upper portion of the sheet bundle; a conveyor configured to convey the sheet floated by the blower; a lift configured to lift up and down the sheet stacker; a first reflective optical sensor configured to detect the sheet floated by the blower; a second reflective optical sensor configured to detect the sheet bundle and a side face of the sheet stacker, the side face including a detection region to be detected by the second reflective optical sensor and a non-detection region not to be detected by the second reflective optical sensor; and circuitry configured to control the lift based on a detection result of the first reflective optical sensor and a detection result of the second reflective optical sensor. The circuitry is configured to cause the lift to lift up the sheet stacker in response to a change from a detection state to a non-detection state of the second reflective optical sensor.

20 Claims, 11 Drawing Sheets

(51) Int. Cl.

| | |
|---|---|
| ***B65H 3/12*** | (2006.01) |
| ***G03G 15/00*** | (2006.01) |
| ***B65H 5/06*** | (2006.01) |
| ***B65H 7/14*** | (2006.01) |
| ***B65H 7/04*** | (2006.01) |
| ***B65H 1/04*** | (2006.01) |

(52) U.S. Cl.
CPC ..... *B65H 5/062* (2013.01); *B65H 7/04* (2013.01); *B65H 7/14* (2013.01); *G03G 15/6511* (2013.01); *B65H 2301/42264* (2013.01); *B65H 2405/111* (2013.01); *B65H 2405/15* (2013.01); *B65H 2511/152* (2013.01); *B65H 2511/22* (2013.01); *B65H 2511/30* (2013.01); *B65H 2511/514* (2013.01); *B65H 2513/40* (2013.01); *B65H 2553/46* (2013.01); *B65H 2553/80* (2013.01); *B65H 2801/06* (2013.01)

(58) Field of Classification Search
CPC ... B65H 7/00; B65H 7/02; B65H 7/04; B65H 7/14; B65H 7/18; B65H 2301/42264; B65H 2405/111; B65H 2405/15; B65H 2511/152; B65H 2511/20; B65H 2511/22; B65H 2511/30; B65H 2513/40; B65H 2553/46; B65H 2553/80
See application file for complete search history.

(56) References Cited

U.S. PATENT DOCUMENTS

| | | | | |
|---|---|---|---|---|
| 2012/0133092 | A1 | 5/2012 | Fuda et al. | |
| 2014/0131938 | A1 | 5/2014 | Satoh et al. | |
| 2014/0339759 | A1 | 11/2014 | Takahashi et al. | |
| 2015/0166280 | A1 | 6/2015 | Hino et al. | |
| 2016/0107854 | A1 | 4/2016 | Hashimoto et al. | |
| 2017/0160689 | A1* | 6/2017 | Sugawara ..... | B65H 7/20 |
| 2017/0327329 | A1 | 11/2017 | Takahashi et al. | |
| 2018/0150006 | A1* | 5/2018 | Furuichi ..... | B65H 3/04 |
| 2019/0127163 | A1* | 5/2019 | Sakamoto ..... | B65H 3/14 |

FOREIGN PATENT DOCUMENTS

| | | |
|---|---|---|
| JP | 2016-124707 | 7/2016 |
| JP | 2017-105563 | 6/2017 |

* cited by examiner

SHEET FEEDING DEVICE, IMAGE FORMING APPARATUS, IMAGE FORMING SYSTEM, AND SHEET PROCESSING APPARATUS

CROSS-REFERENCE TO RELATED APPLICATIONS

This patent application is based on and claims priority pursuant to 35 U.S.C. § 119(a) to Japanese Patent Application No. 2017-254510, filed on Dec. 28, 2017, and No. 2018-145287, filed on Aug. 1, 2018, in the Japan Patent Office, the entire disclosure of which is hereby incorporated by reference herein.

BACKGROUND

Technical Field

Aspects of the present disclosure relate to a sheet feeding device, an image forming apparatus, an image forming system, and a sheet processing apparatus that performs processing on a sheet.

Related Art

A sheet feeding device is known that is incorporated in or coupled to a processing apparatus, such as an electrophotographic or inkjet image forming apparatus, and floats the uppermost sheet of a bundle of sheets, such as a sheet or a prepreg, to feed (convey) the sheet with a conveyor, such as an attracting conveyance unit.

SUMMARY

In an aspect of the present disclosure, there is provided a sheet feeding device that includes a sheet stacker, a blower, a conveyor, a lift, a second reflective optical sensor, and circuitry. The sheet stacker is configured to stack a sheet bundle. The blower is configured to float a sheet on an upper portion of the sheet bundle. The conveyor is configured to convey the sheet floated by the blower. The lift is configured to lift up and down the sheet stacker; a first reflective optical sensor configured to detect the sheet floated by the blower. The second reflective optical sensor is configured to detect the sheet bundle and a side face of the sheet stacker. The side face includes a detection region to be detected by the second reflective optical sensor and a non-detection region not to be detected by the second reflective optical sensor. The circuitry is configured to control the lift based on a detection result of the first reflective optical sensor and a detection result of the second reflective optical sensor. The circuitry is configured to cause the lift to lift up the sheet stacker in response to a change from a detection state to a non-detection state of the second reflective optical sensor.

In another aspect of the present disclosure, there is provided an image forming apparatus that includes the sheet feeding device configured to separate and feed a sheet from the sheet bundle and an image forming device configured to form an image on the sheet.

In still another aspect of the present disclosure, there is provided an image forming system that includes the sheet feeding device configured to separate and feed a sheet from the sheet bundle and an image forming apparatus configured to form an image on the sheet that has been fed from the sheet feeding device.

In still yet another aspect of the present disclosure, there is provided a sheet processing apparatus that includes the sheet feeding device configured to separate and feed a sheet from a sheet bundle and a sheet processing device configured to perform processing on the sheet that has been separated and fed from the sheet feeding device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
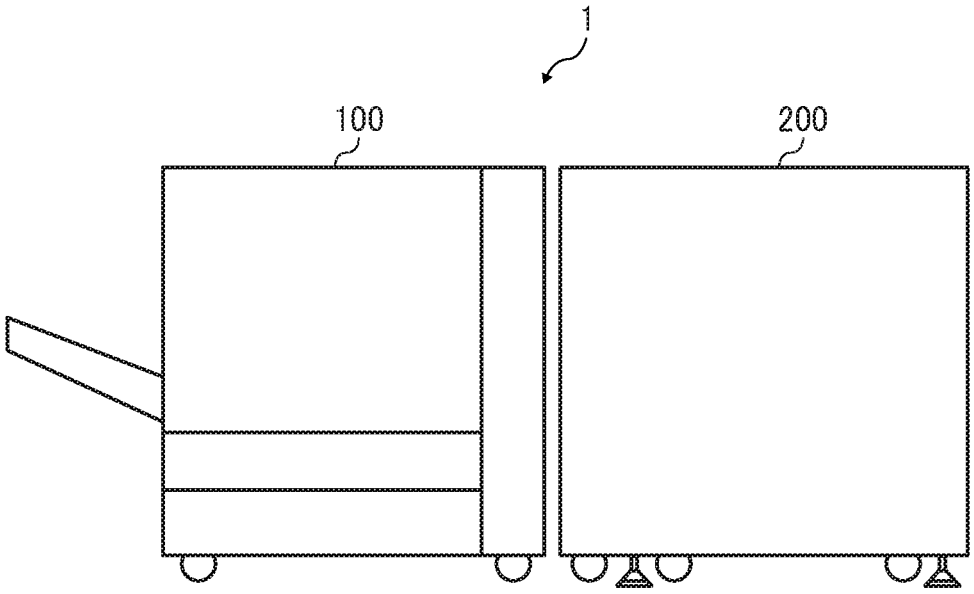
FIG. 1 is a schematic configuration view of an image forming system according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, an embodiment of a sheet feeding device to the present invention is applied will be described.

FIG. 1 is a schematic configuration view of an image forming system 1 according to the present embodiment.

As illustrated in FIG. 1, the image forming system 1 includes an electrophotographic image forming apparatus 100 serving as an image former that forms an image on a sheet, and a sheet feeding device 200 that feeds a sheet to the image forming apparatus. The sheet feeding device is provided on a side face of an apparatus body of the image forming apparatus 100.

First, the general arrangement and operation of the image forming apparatus such as a printer to which the sheet feeding device of the present embodiment can be applied, and a copier including an equivalent image forming function will be described.

Figure 2:
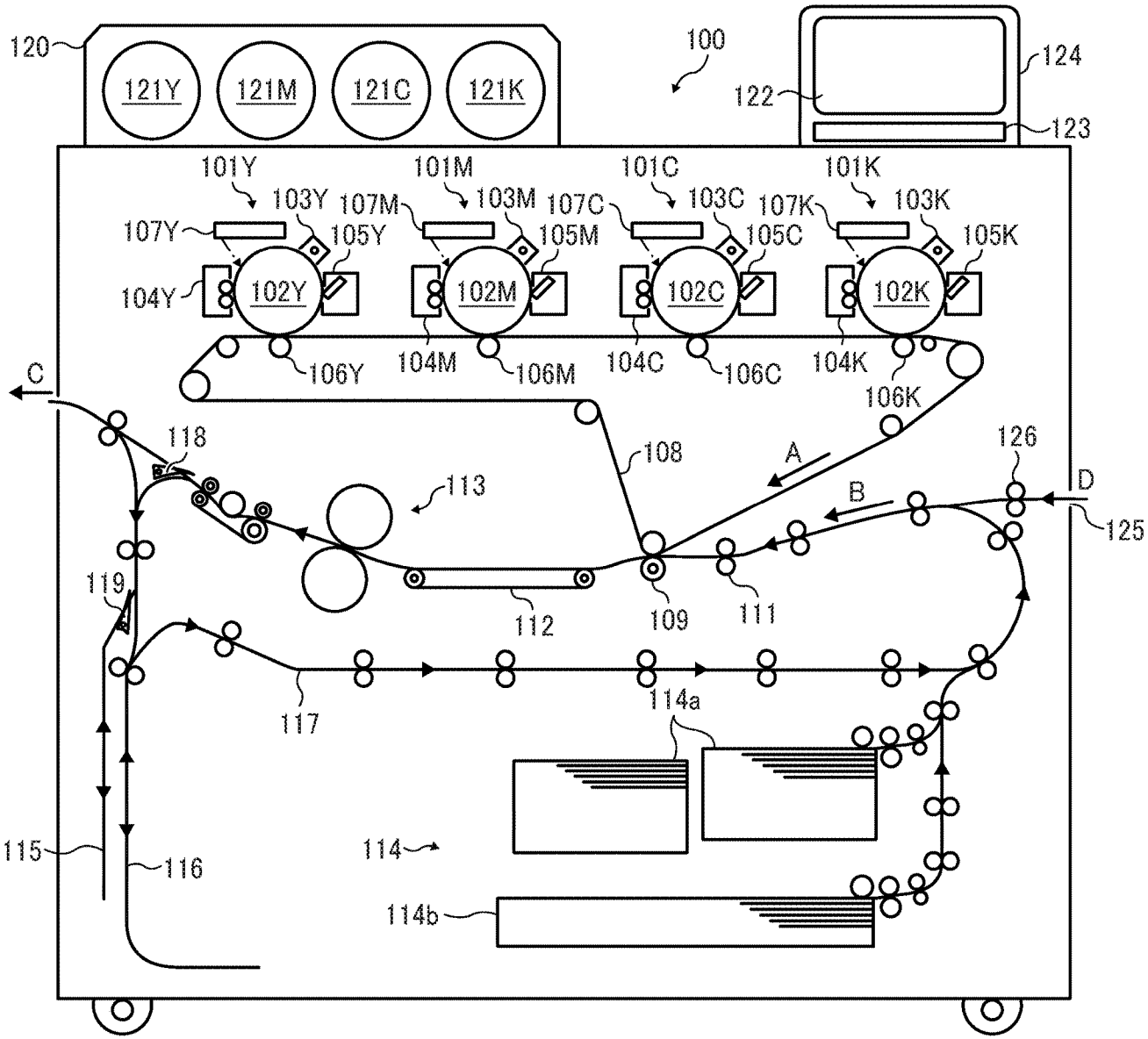
FIG. 2 is a schematic configuration view of an image forming apparatus according to the embodiment.

FIG. 2 is a schematic configuration view of the image forming apparatus 100 according to the present embodiment.

The image forming apparatus 100 is a full-color printer that uses toners of four colors of yellow (Y), cyan (C), magenta (M), and black (K) and includes an equivalent image forming function. As illustrate in FIG. 2, four image forming units 101Y, 101M, 101C, and 101K are disposed side by side in an upper portion in the apparatus body. The four image forming units 101Y, 101M, 101C, and 101K serve as image forming devices that form an image with the respective color toners.

The arrangement and operation of each of the image forming units 101Y, 101M, 101C, and 101K are substantially the same. Therefore, the image forming unit may be described below by omitting the signs (Y, C, and K) indicating the colors. Each image forming unit 101 has, for example, a charger 103 (103Y, 103M, 103C, or 103K), a developing device 104 (104Y, 104M, 104C, or 104K), and a cleaning device 105 (105Y, 105M, 105C, or 105K) disposed in the periphery of a photoconductor drum 102 (102Y, 102M, 102C, or 102K) serving as an image bearer. Furthermore, an exposure unit 107 (107Y, 107M, 107C, or 107K) is disposed above the photoconductor drum 102.

An intermediate transfer belt 108 wound around a plurality of support rollers is disposed below the four image forming units 101Y, 101M, 1010, and 101K. One of the support rollers is rotationally driven by a driver, so that the intermediate transfer belt 108 is driven to travel in the direction of arrow A. A transfer roller 106 serving as a primary transferor is disposed facing the photoconductor drum 102 of the image forming unit 101 via the intermediate transfer belt 108.

In the image forming unit 101, the photoconductor drum 102 is rotationally driven counterclockwise in the view, and the surface of the photoconductor drum 102 is uniformly charged to a predetermined polarity by the charger 103. Subsequently, the charged surface is irradiated with a light-modulated laser beam emitted from the exposure unit 107, so that an electrostatic latent image is formed on the photoconductor drum 102. The formed electrostatic latent image is developed with the toner given by the developing device 104 to be visualized as a toner image. The toner images of yellow cyan, magenta, and black formed by each of the image forming units 101 are transferred so as to be sequentially superimposed on the intermediate transfer belt 108.

On the other hand, a sheet feeder 114 is provided at a lower portion of the apparatus body, the sheet feeder 114 including a feeding tray 114*a* and a feeding tray 114*b*. A sheet such as a sheet or a prepreg is fed from either the sheet feeder 114 or the sheet feeding device 200 coupled to the image forming apparatus 100, to be described in detail later. The fed sheet is conveyed in the direction of arrow B to a registration roller 111.

The sheet abutted against the registration roller 111 and temporarily stopped is delivered from the registration roller 111 in timing with the toner image on the intermediate transfer belt 108. Then the sheet is sent into a secondary transfer portion where a secondary transfer roller 109 and the intermediate transfer belt 108 come into contact with each other. A voltage having a polarity opposite to the charging polarity of the toner is applied to the secondary transfer roller 109. Thus, the superimposed toner image (full color image) on the intermediate transfer belt 108 is transferred onto the sheet. The sheet after the transfer of the toner image is conveyed to a fixing device 113 by a conveying belt 112. Thus, the toner is fixed on the sheet by heat and pressure at the fixing device 113. The sheet after the toner image has been fixed is ejected outside the apparatus as indicated by arrow C to be stacked on an ejection tray.

Here, in the case of back-side sheet ejection (face-down sheet ejection) by single-sided printing, the sheet is ejected outside the apparatus as indicated by the arrow C via a sheet reversing portion 115. Thus, the front and back sides of the sheet are reversed. In the case of duplex printing, the sheet after fixing is conveyed again from a refeeding path 117 to the registration roller 111 via a reversing portion 116, and the toner image is transferred from the intermediate transfer belt 108 to the back side of the sheet. The sheet after the transfer of the toner image is fixed at the fixing device 113. As in the case of single-sided printing, the sheet is ejected outside the apparatus from the fixing device 113 as indicated by the arrow C, or via the sheet reversing portion 115 as indicated by the arrow C, to be stacked on the ejection tray. Switching claws 118 and 119 that switch the sheet conveying direction are appropriately disposed on the sheet conveyance path.

In the case of monochrome printing, for the image forming apparatus 100 of the present embodiment, the toner image is formed using only the image forming unit 101K of black (K), and then the toner image is transferred onto the sheet via the intermediate transfer belt 108. The handling of the sheet after the fixing of the toner image is the same as in the case of full-color printing.

The upper face of the apparatus body has a toner bottle set housing 120 in which toner bottles 121 for the colors containing toner are set so as to be supplied to the developing devices 104 of the image forming units 101. The upper face of the apparatus body has also an operation unit 124, the operation unit 124 including a display 122 and an operation panel 123.

The side face on the right side in the view of the image forming apparatus 100 illustrated in FIG. 2 has a sheet carrier D leading from a sheet feeding device 200 (see FIG. 3) to be described later. The sheet carrier D has an opening 125 that receives a sheet and a conveyor 126 that conveys the sheet.

Figure 3:
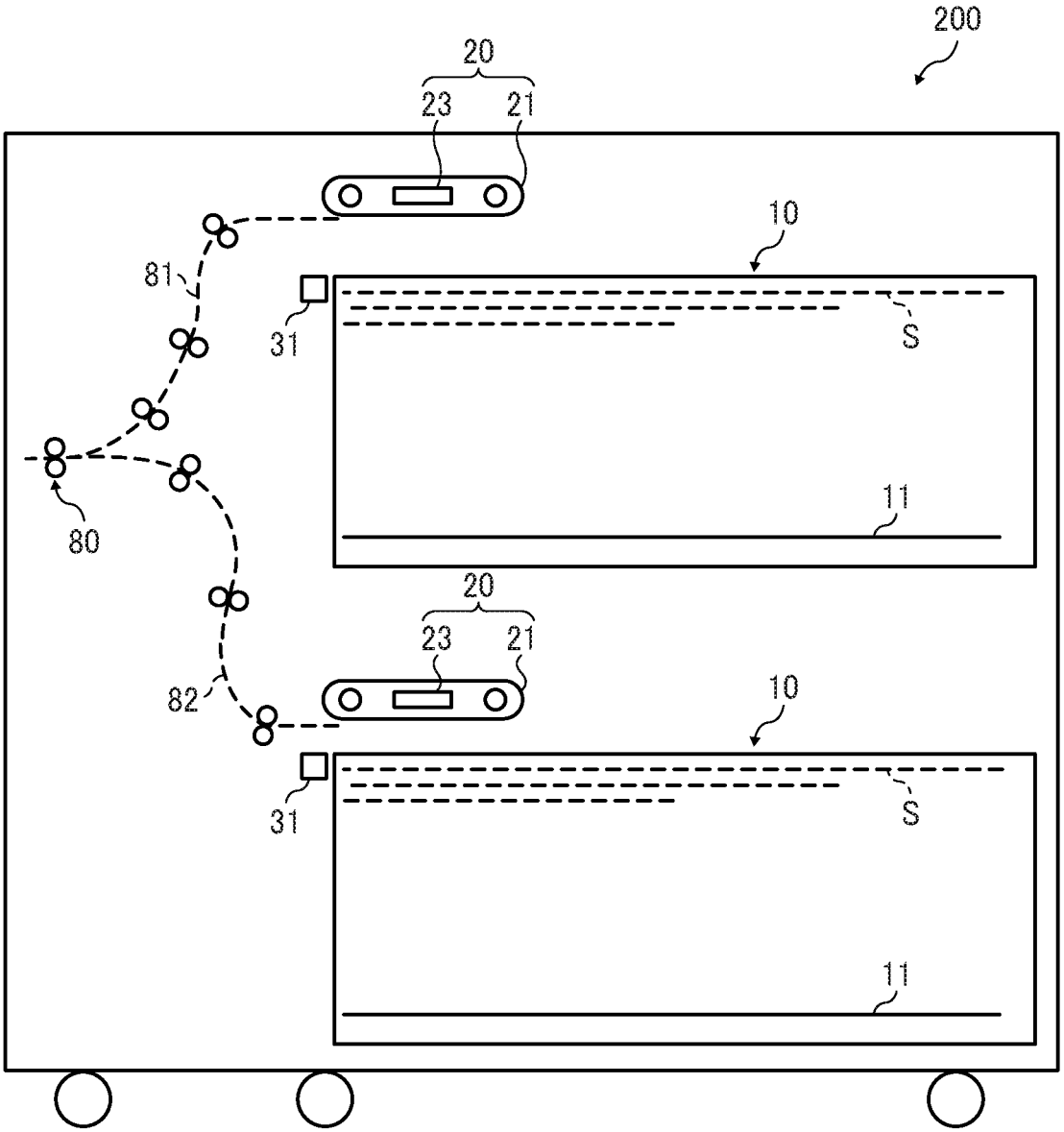
FIG. 3 is a schematic configuration view of a sheet feeding device according to the embodiment.

FIG. 3 is a schematic explanatory view of the sheet feeding device 200 according to the present embodiment coupled to the side face of the apparatus body of the image forming apparatus 100.

The sheet feeding device 200 includes two feeding trays 10 tandem up and down. The feeding trays 10 each include a sheet stacker 11 on which a bundle of sheets S is stacked. In the present embodiment, the feeding trays 10 each are capable of storing a maximum of about 2500 sheets. An attracting conveyance unit 20 is disposed above each feeding tray 10, the attracting conveyance unit 20 serving as a conveyor that attracts a sheet S stacked on the feeding tray 10 to convey the sheet S. The attracting conveyance unit 20 includes an attracting belt 21 that is a conveyance member and a suction device 23. That is, the sheet feeding device 200 is a so-called air-pickup sheet feeding device.

Furthermore, the feeding tray 10 each adopt sheet-face detection control. The control causes a sheet detection sensor 31 including two reflective optical sensors to detect a plurality of sheet side faces of an upper portion of the sheet bundle stacked on the sheet stacker 11. Then the control lifts up and down the sheet stacker 11 in accordance with the output value.

The sheet detection sensor 31 includes a first lateral upper-surface sensor 31*a* and a second lateral upper-surface sensor 31*b* to be described later.

A sheet stacked on the lower feeding tray 10 passes through a lower conveyance path 82 to be conveyed to the apparatus body of the image forming apparatus 100 by a pair of exit rollers 80. On the other hand, a sheet stacked on the upper feeding tray 10 passes through an upper conveyance path 81 to be conveyed to the apparatus body of the image forming apparatus 100 by the pair of exit rollers 80.

Figure 4:
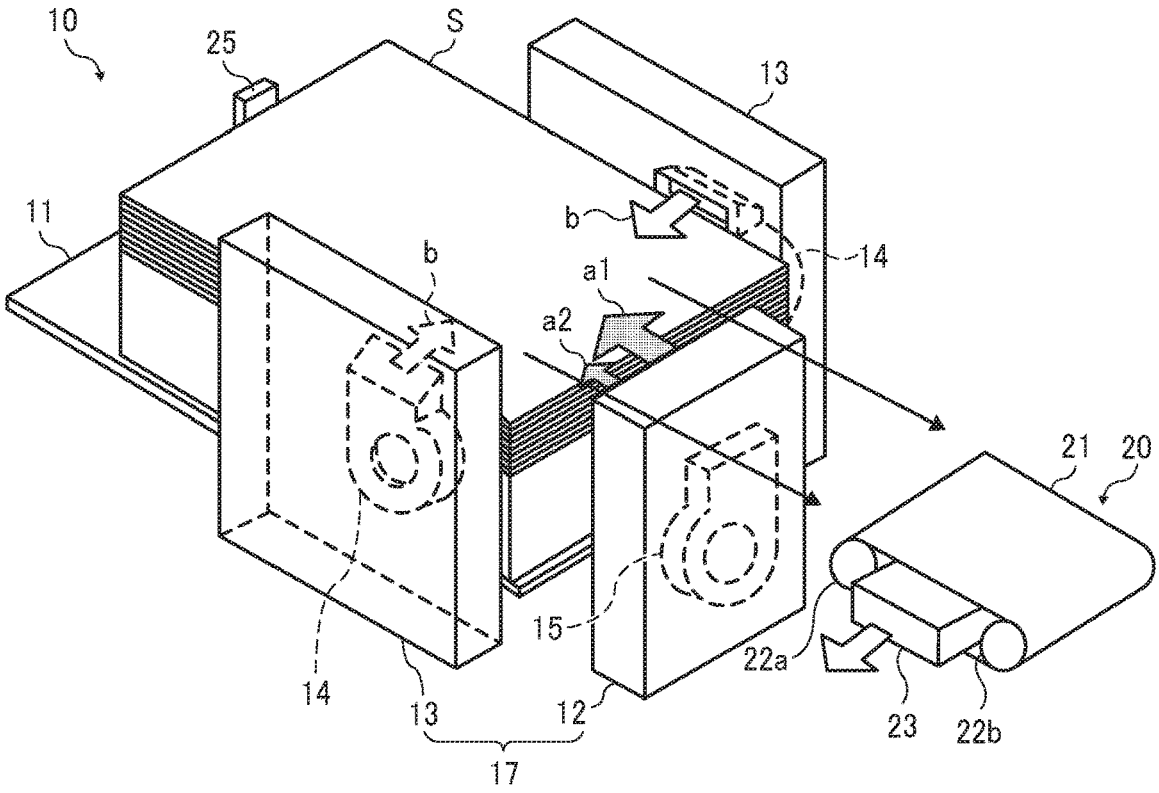
FIG. 4 is a schematic perspective view of the vicinity of a feeding tray of a sheet feeding device.

FIG. 4 is a schematic perspective view of the vicinity of a feeding tray) of the sheet feeding device 200.

The attracting belt 21 of the attracting conveyance unit 20 has been tensed over two tension rollers 22*a* and 22*b*. A suction hole is provided in the entire region in the circumferential direction, the suction hole penetrating from the front side to the back face side of the attracting belt 21. The suction device 23 is provided inside the attracting belt 21. The suction device 23 is coupled to a suction fan, the suction fan sucking air through an air duct that is an air flow path. The suction device 23 generates a negative pressure downward to work so as to cause the sheet S to be attracted on the lower face of the attracting belt 21.

In addition, the feeding tray 10 includes a blowing device 17, the blowing device 17 serving as a blower that blows air onto sheets S on an upper portion of a sheet bundle Sb. The blowing device 17 includes a front blower 12 and a pair of side blowers 13.

The front blower 12 blows air to the front end (end on the downstream side in the feeding direction) of the upper portion of the sheet bundle Sb. The front blower 12 includes a floating nozzle, a separating nozzle, and a blowing fan 15. The floating nozzle guides air in a direction in which sheets on the upper portion of the sheet bundle Sb are to be floated. The separating nozzle guides air in a direction in which the uppermost floated sheet and the other sheets are to be separated. The blowing fan 15 sends air into the floating nozzle and the separation nozzle. Of the nozzles, air blown from the floating nozzle in the direction indicated by arrow a1 in the view is called floating air, and air blown from the separating nozzle in the direction indicated by arrow a2 is called separating air. The floating air and the separating air each are discharged from a location opposed to the front end (end on the downstream side in the feeding direction) of the upper portion of the sheet bundle Sb. Then the floating air and the separating air are blown to the front end (end on the downstream side in the feeding direction) of the upper portion of the sheet bundle Sb.

A blowing fan 14 is provided on a side fence of each side blower 13. The blowing fan 14 blows air to a side face of the upper portion of the sheet bundle Sb in the direction indicated by arrow b in the view. The side blower 13 includes a side floating nozzle that guides air in a direction in which the sheet bundle Sb is to be separated and floated. The air blown in the direction indicated by the arrow b from the nozzle is called side air. The side air is discharged from a discharge port provided at a location of each side blower 13 opposed to the upper portion of the sheet bundle Sb. Then the side air is blown to a side face of the upper portion of the sheet bundle Sb. The air blown from the front blower 12 and the discharge ports of the pair of side blowers causes the sheets of the upper portion of the sheet bundle Sb to float.

The feeding tray 10 has an end fence 25 that aligns the back end of the sheet bundle Sb stacked on the sheet stacker 11.

Figure 5:
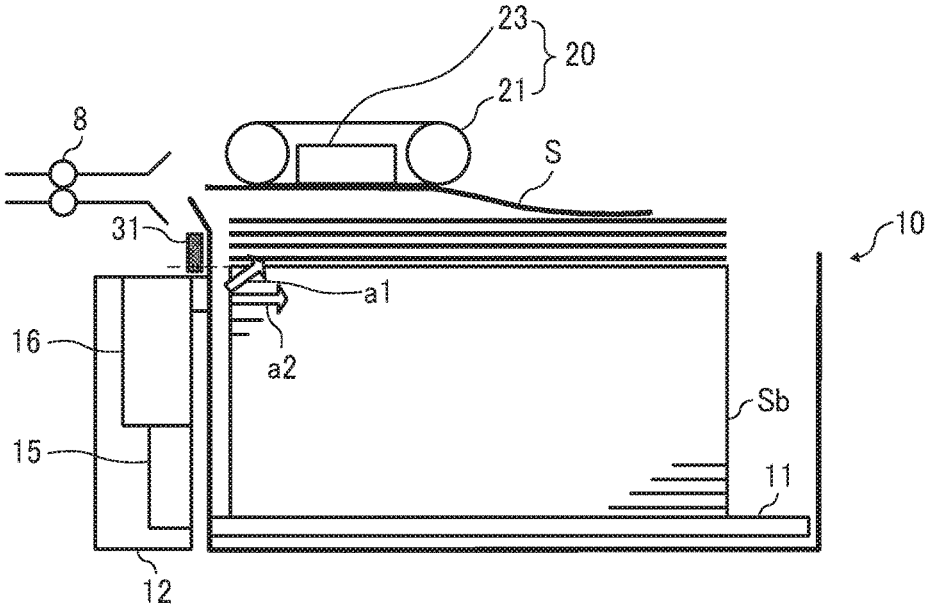
FIG. 5 is a schematic cross-sectional view of the vicinity of the feeding tray of the sheet feeding device.

FIG. 5 is a schematic cross-sectional view of the vicinity of the feeding tray 10 of the sheet feeding device 200.

A pair of conveying rollers 8 that is a downstream-side conveyance member is disposed on the downstream side in the conveying direction with respect to the attracting belt 21. The conveying rollers 8 convey, further toward the downstream side, the sheet S that has been separated from the sheet bundle Sb, conveyed by the attracting belt 21, and reached between two rollers.

Furthermore, the sheet detection sensor 31 described above is provided along the sheet stacking direction as illustrated in FIG. 5.

In the present embodiment, as described above, the sheet detection sensor 31 includes the first lateral upper-surface sensor 31*a* and the second lateral upper-surface sensor 31*b*. The sheet detection sensor 31 is a reflective optical sensor, and includes a light emitting element and a light receiving element.

Furthermore, the front blower 12 has the blowing fan 15, the floating nozzle, the separating nozzle, and a blowing duct 16. The blowing duct 16 guides air into the floating nozzle and the separating nozzle.

Next, the sheet detection sensor 31 and lifting control of the sheet stacker 11 will be described with reference to the drawings.

Figure 6:
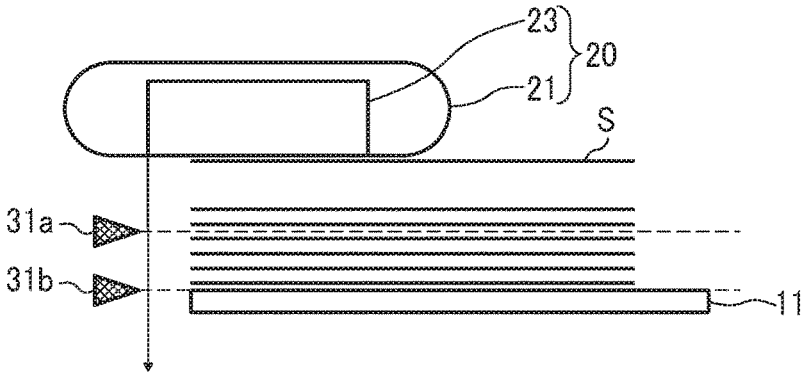
FIG. 6 is an explanatory view of a first lateral upper-surface sensor and a second lateral upper-surface sensor.

FIG. 6 is an explanatory view of the first lateral upper-surface sensor 31*a* and the second lateral upper-surface sensor 31*b*.

The first lateral upper-surface sensor 31*a* and the second lateral upper-surface sensor 31*b* illustrated in FIG. 6 are selectively used depending on whether the sheet is being fed. The first lateral upper-surface sensor 31*a* is used during floating in which the floating air is blown onto the sheets, that is, during feeding. On the other hand, the second lateral upper-surface sensor 31*b* detects the side face of the sheet bundle Sb during non-floating.

In addition, the first lateral upper-surface sensor 31*a* is set so as to detect a position 12 mm lower from the suction surface of the attracting belt 21. The second lateral upper-surface sensor 31*b* is set so as to detect a position 18 mm lower from the suction surface of the attracting belt 21.

Figure 7:
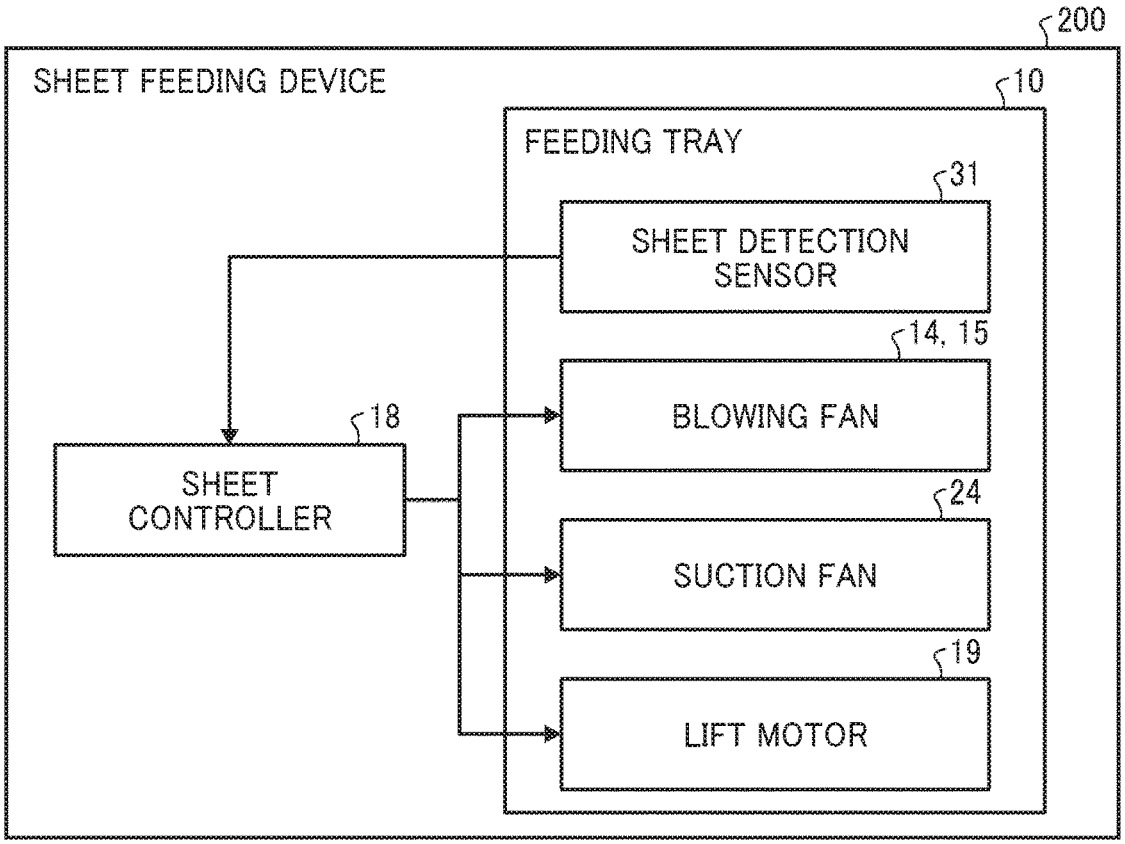
FIG. 7 is a block diagram illustrating an example of the arrangement of a control system of the sheet feeding device.

FIG. 7 is a block diagram illustrating an example of the arrangement of a control system of the sheet feeding device 200.

As illustrated in FIG. 7, the lateral upper-surface sensors 31*a* and 31*b* of the feeding tray 10 are coupled to a sheet controller 18 serving as circuitry of the sheet feeding device 200. The blowing fan 15, the blowing fan 14, and a suction fan 24 of the suction device 23 are also coupled to the sheet controller 18. The blowing fan 15 blows air into the floating nozzle and the separating nozzle of the front blower 12. The blowing fan 14 blows air into the side floating nozzle of the side blower 13. A lift motor 19 included in a lift 190 that lifts up and down the sheet stacker 11 is also coupled to the sheet controller 18.

The sheet controller 18 is included in the sheet feeding device 200 as described above. As a result, even in the case of coupling to the image forming apparatus 100 where the lift motor 19 that lifts up and down the sheet stacker 11 cannot be directly controlled, the sheet feeding device 200 capable of feeding a sheet at an appropriate timing can be provided.

Figure 8:
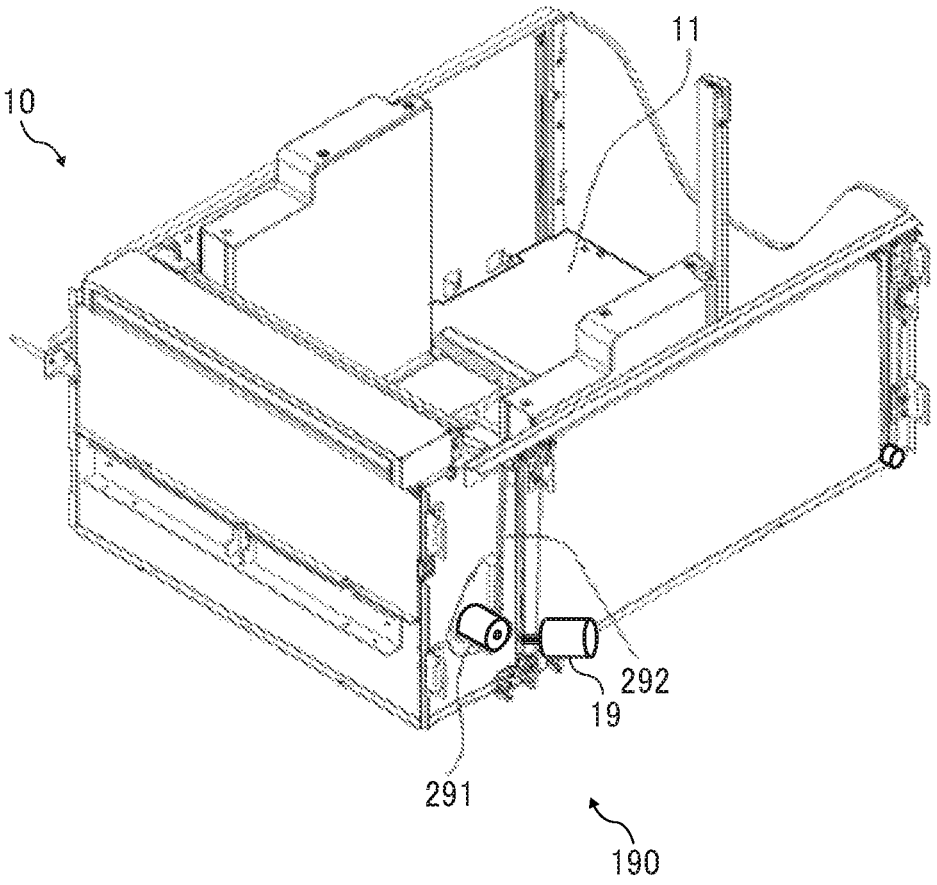
FIG. 8 is a schematic explanatory view of a lift of the sheet feeding device.

FIG. 8 is a schematic explanatory view of the lift of the sheet feeding device.

As illustrated in FIG. 8, the sheet stacker 11 is coupled to a wire 292. A pulley 291 rotates to wind up the wire 292, so that the sheet stacker 11 is horizontally lifted up. The pulley 291 is coupled to a drive shaft of the lift motor 19 via a gear train. The drive shaft of the lift motor 19 rotates to wind up the wire 292.

Figure 9:
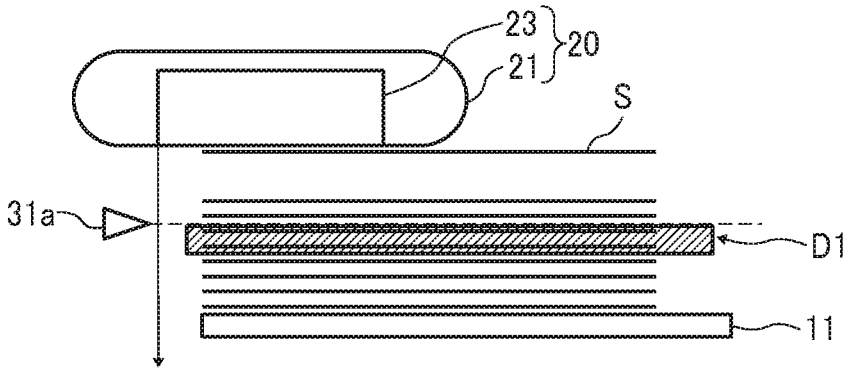
FIG. 9 is an explanatory view of an example of lifting control of a sheet stacking base according to a detection result of a sheet detection sensor.

FIG. 9 is an explanatory view of an example of the lifting control of the sheet stacker 11 in accordance with the detection result of the sheet detection sensor 31.

As in illustrated in FIG. 9, based on the output value of the first lateral upper-surface sensor 31*a*, the sheet controller 18 detects sheet density (whether the sheets exist densely or sparsely) in a certain region in front of the sensor. When the number of sheets decreases due to the feeding operation and the density of the floated sheets in a monitor region D1 is more sparse (that is, in non-detection state) than a preset threshold, the sheet controller 18 causes the lift 190 to lift up the sheet stacker 11.

Next, the reason why insufficient floating of a sheet occurs at the time of almost running out of the sheet bundle on the sheet stacker 11, which causes non-feeding of the sheet, will be described with reference to the drawings.

Figure 10:
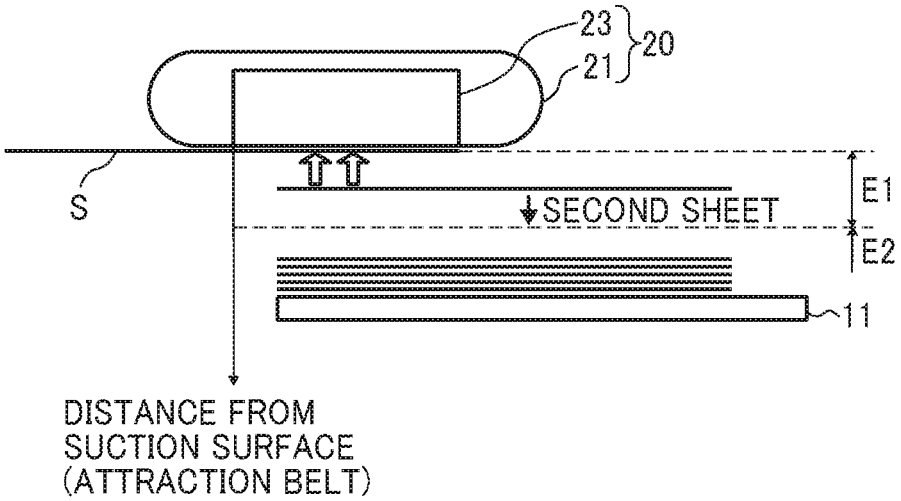
FIG. 10 is an explanatory view of an attractable area for an attracting conveyance unit.

FIG. 10 is an explanatory view of an attractable area E1 for the attracting conveyance unit 20.

The position of the sheet stacker 11 is controlled in accordance with the detection result of the first lateral upper-surface sensor 31*a*, to position the uppermost sheet of the floating sheet bundle in the attractable area E1 illustrated in FIG. 10. Here, the attractable area E1 is an area where the attracting belt 21 of the attracting conveyance unit 20 can attract a sheet.

Meanwhile, when the uppermost sheet is separated from the attractable area E1, the attracting conveyance unit 20 cannot attract the uppermost sheet. Thus, non-feeding of the sheet, so-called non sheet feeding occurs. The area where the non sheet feeding occurs is hereinafter referred to as a non sheet-feeding occurrence area E2.

Figure 11A:
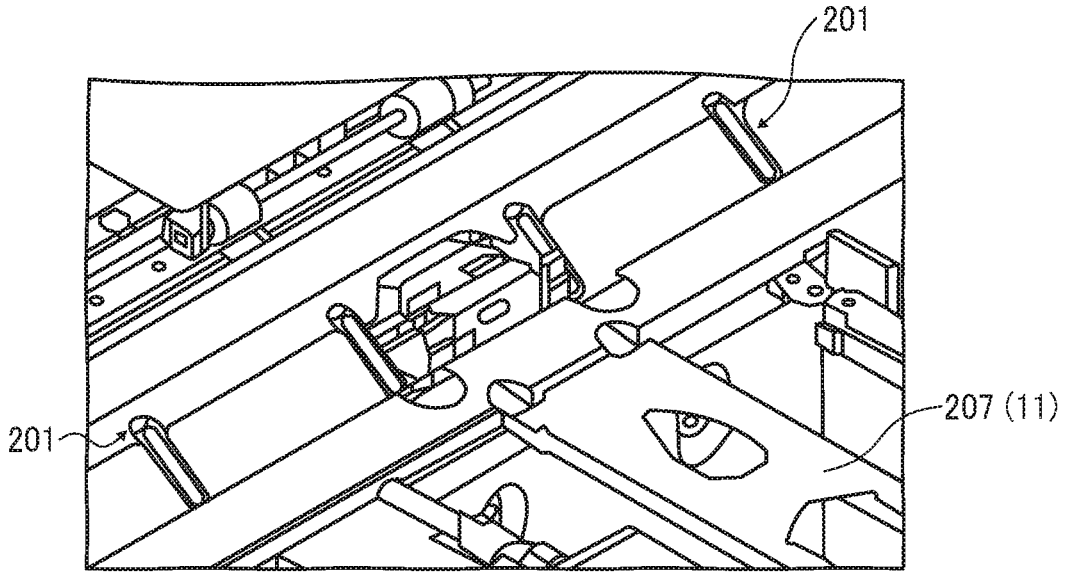
FIGS. 11A and 11B are explanatory views of the positional relationship between a sheet stacker and a floating nozzle at the time of almost running out.
Figure 11B:
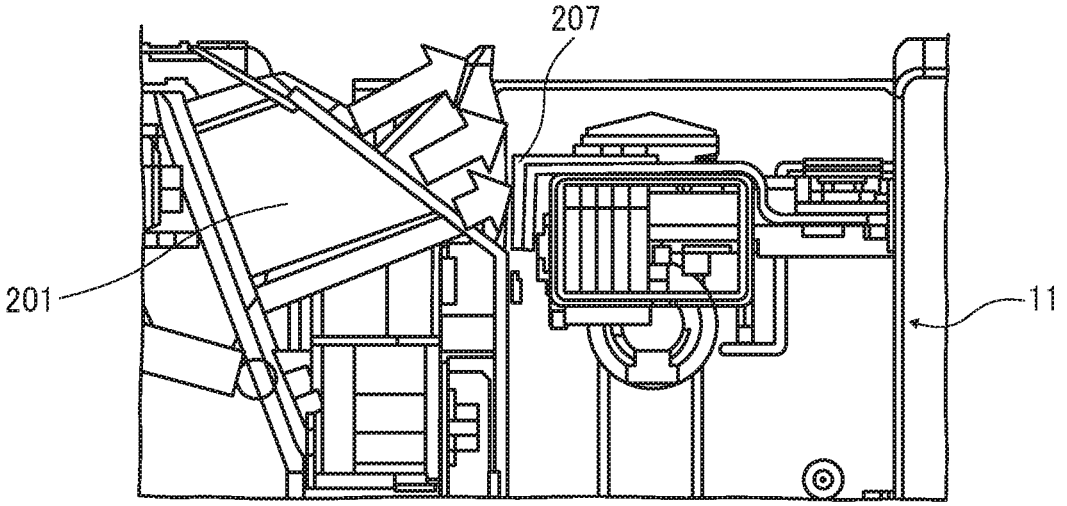

FIGS. 11A and 11B are explanatory views of the positional relationship between the sheet stacker 11 and a floating nozzle 201 at the time of almost running out. FIG. 11A is an explanatory perspective view in the vicinity of the floating nozzle 201, and FIG. 11B is an explanatory cross-sectional view in the vicinity of the floating nozzle 201.

When the number of the sheets of the sheet bundle stacked on the sheet stacker 11 decreases and the sheet bundle on the sheet stacker 11 is in almost running out, as illustrated in FIGS. 11A and 11B, a bottom plate 207 of the sheet stacker 11 rises to a position at which the air from the front blower 12 being the blower of air is blocked. Consequently, since the air is difficult to blow to the sheets, the sheets are difficult to float. Thus, there is a disadvantage that even when the floated sheets exist in the monitor region D1 of the first lateral upper-surface sensor 31*a*, the uppermost floated sheet is difficult to float up to the attractable area E1.

Figure 12:
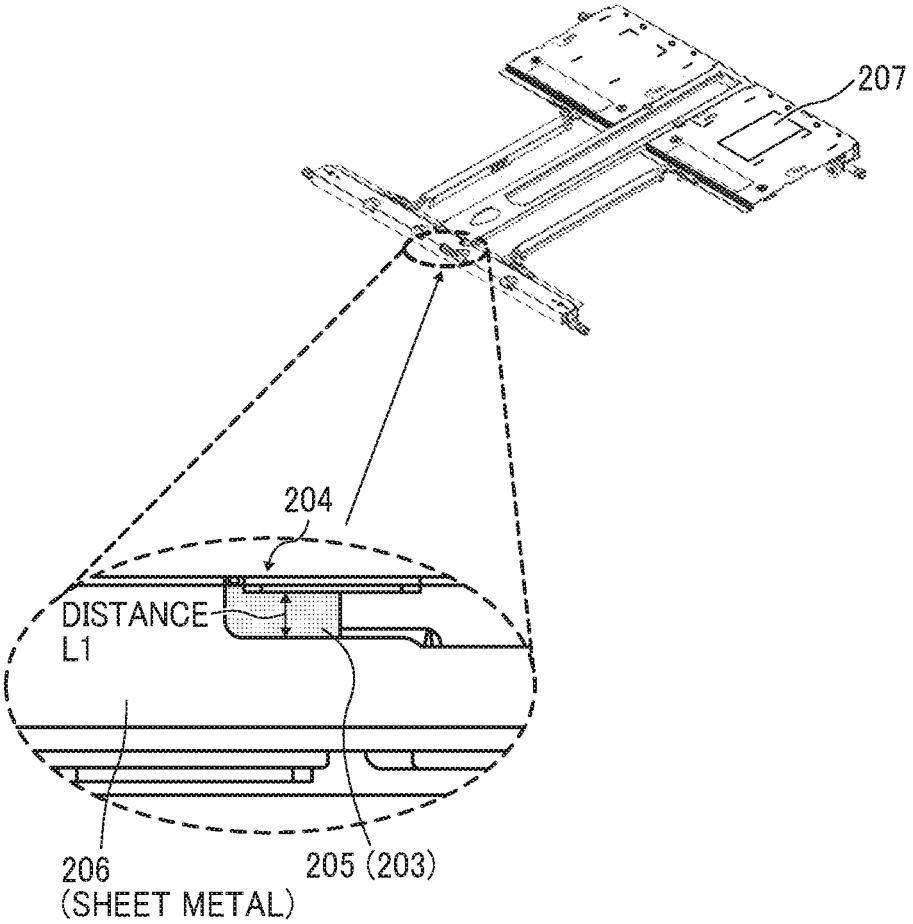
FIG. 12 is an explanatory view of a structure of a sheet stacker that reduces occurrence of non-feeding of a sheet.

FIG. 12 is an explanatory view of a structure of the sheet stacker 11 that reduces occurrence of non-feeding of a sheet.

During sheet feeding, as the sheets stacked on the sheet stacker 11 are fed, a surface to be detected (hereinafter, appropriately referred to as detection surface 204) gradually rises while facing the lateral upper-surface sensors 31*a* and 31*b*. The detection surface 204 is provided on a side face of the sheet stacker 11 and is to be detected by the lateral upper-surface sensors 31*a* and 31*b*. The detection surface 204 includes a sheet metal that can be detected by the lateral upper-surface sensors 31*a* and 31*b*.

The detection surface 204 is provided with a non-detection region 205 that does not reflect light from a light emitter of each of the lateral upper-surface sensors 31*a* and 31*b*.

The distance (length) in the height direction (direction along the lifting direction of the sheet stacker 11) of the non-detection region 205 is a distance A from a position where the sheet stacker 11 comes to the height of a position where the sheet stacker 11 blocks the air to a position where the floated sheets can float to the attractable area E1 (experimental value obtained from evaluation). As illustrated in FIG. 12, a suede material (member) 203 is attached (provided) on the detection surface 204, so that the non-detection region 205 of the lateral upper-surface sensors 31*a* and 31*b* is formed. The suede material 203 serves as a reflection reducing material to reduce the reflection of the light from the light emitter of each of the respective lateral upper-surface sensors 31*a* and 31*b*. The non-detection region 205 is formed with the attachment of the suede material 203 in this manner. Thus, the accuracy of position detection in the height direction of the sheet stacker (accuracy of lifting operation) can be improved with the simple configuration.

Here, in the detection surface 204, a metal sheet portion on which the suede material 203 is not attached and the light is reflected is a detection region 206. As a reflection reducing material to be provided, in addition to the attachment of the suede material 203, a sheet or a film that prevents light reflection may be attached, or such a material may coat a desired range of the detection surface 204.

Next, using the sheet stacker 11 provided with the non-detection region 205 as described above, the flow of control when sheet feeding operation is performed, the position of the bottom plate 207 of the sheet stacker 11 in almost running out, and forceful lift-up operation of the sheet stacker 11 will be described.

Figure 13:
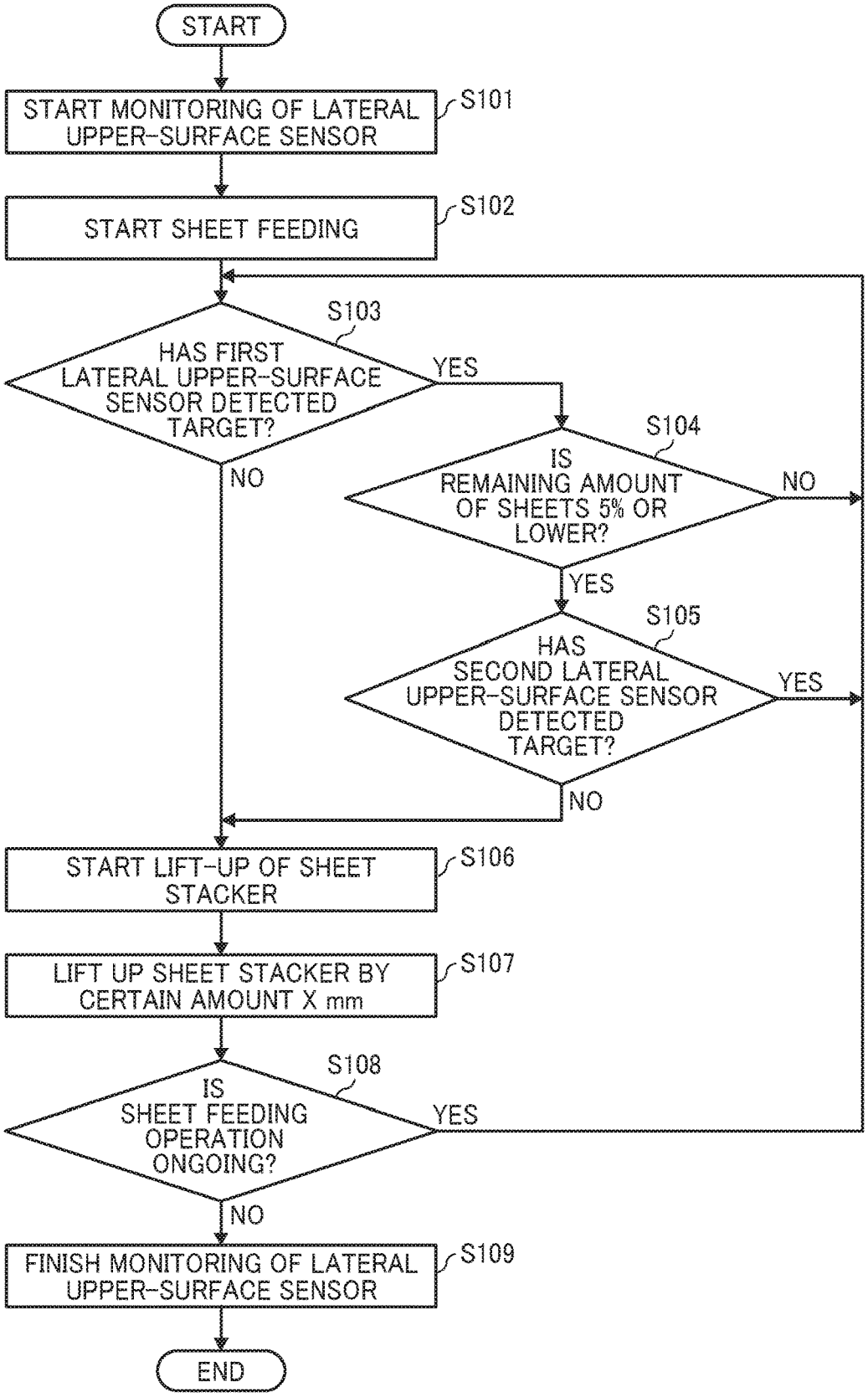
FIG. 13 is a control flowchart of the lifting operation of the sheet stacker.
Figure 14:
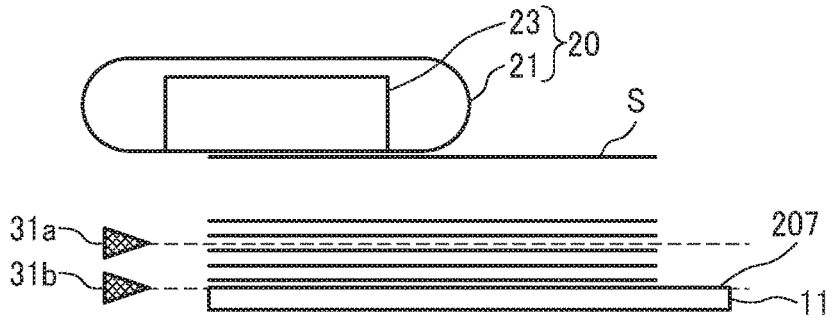
FIG. 14 is an explanatory view of the position of a bottom plate of the sheet stacker in almost running out.
Figure 15A:
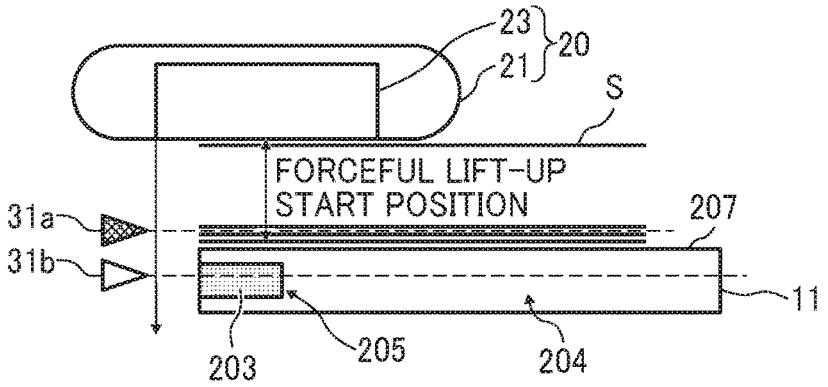
FIGS. 15A and 15B are explanatory views of forceful lift-up of the sheet stacker.
Figure 15B:
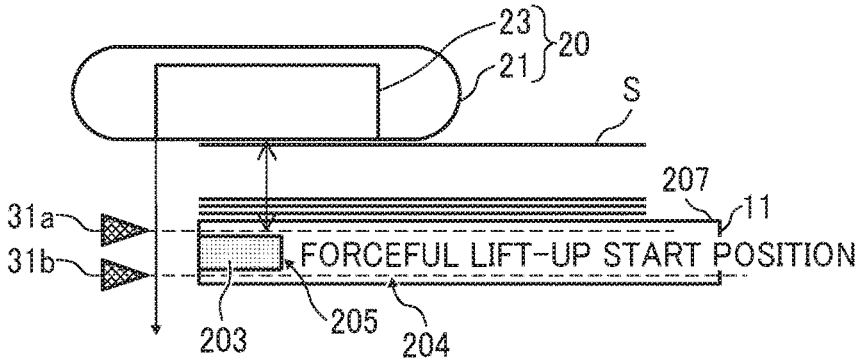

FIG. 13 is a control flowchart of the lifting operation of the sheet stacker 11, and FIG. 14 is an explanatory view of the position of the bottom plate 207 of the sheet stacker 11 in almost running out. FIGS. 15A and 15B are explanatory views of forceful lift-up of the sheet stacker 11. FIG. 15A is an explanatory view of the start position of the forceful lift-up, and FIG. 15B is an explanatory view of the end position of the forceful lift-up.

Normally, during sheet feeding, only a state of the first lateral upper-surface sensor 31*a* is monitored, and control of the lift-up operation of the sheet stacker 11 is performed.

However, when the remaining sheet quantity calculated by a remaining quantity detector that detects the remaining quantity of the sheets stacked on the sheet stacker 11 becomes equal to or less than a certain threshold (for example, equal to or less than 5%), the second lateral upper-surface sensor 31*b* is monitored at the same time of monitoring of the first lateral upper-surface sensor 31*a*. Then, in a case where either the lateral upper-surface sensor 31*a* or the lateral upper-surface sensor 31*b* is rendered in non-detection, the sheet controller 18 performs the control that causes the sheet stacker 11 to rise (see FIG. 13).

For example, when the remaining sheet quantity becomes equal to or less than 5%, the sheet stacker 11 rises to the height of the second lateral upper-surface sensor 31*b*. Thus, the second lateral upper-surface sensor 31*b*, as illustrated in FIG. 14, can substantially monitor the detection surface 204 on the side face of the sheet stacker 11 (see FIGS. 15A and 15B).

Adoption of this arrangement can further enhance the effect of reducing the occurrence of non-feeding of the sheet S due to insufficient floating of the sheet S at the time of almost running out of the sheet bundle Sb on the sheet stacker 11.

As an example of a specific control flow, as indicated in the flowchart of FIG. 13, in control of the sheet feeding operation, first, the lateral upper-surface sensors 31*a* and 31*b* each start monitoring the sheet or the detection surface 204 (hereinafter referred to as a detection subject) (S101). The lateral upper-surface sensors 31*a* and 31*b* each start monitoring in this manner, and then sheet feeding starts (S102).

Then, it is determined whether the first lateral upper-surface sensor 31*a* has detected the detection subject (S103). In a case where the detection subject has been detected (Yes in S103), it is determined whether the remaining sheet quantity is equal to or less than 5% (S104). On the other hand, in a case where the detection subject has not been detected (No in S103), the lift-up operation of the sheet stacker 11 is performed (S106).

In the determination whether the remaining sheet quantity is equal to or less than 5% (S104), in a case where it is determined that the remaining sheet quantity is equal to or less than 5% (Yes in S104), it is determined that whether the second lateral upper-surface sensor 31*b* has detected the detection subject (S105). On the other hand, in a case where the determination is No, that is, it is determined that the remaining sheet quantity is more than 5% (No in S104), the flow returns to the determination whether the first lateral upper-surface sensor 31*a* has detected the detection subject (S103).

In the determination whether the second lateral upper-surface sensor 31*b* has detected the detection subject (S105), in a case where it is determined that the detection subject has been detected (Yes in S105), the flow returns to the determination whether the first lateral upper-surface sensor 31*a* has detected the detection subject (S103). On the other hand, when the detection subject has not been detected (No in S105), the lift-up operation of the sheet stacker 11 is performed (S106).

After the performance of the lift-up operation of the sheet stacker 11 S106), in a case where the sheet stacker 11 has been lifted by a certain amount X [mm] (S107), it is determined whether the sheet feeding operation has continued (S108).

In the determination (S108), in a case where it is determined that the sheet feeding operation has continued (Yes in S108), the flow returns to the determination whether the first lateral upper-surface sensor 31*a* has detected the detection subject (S103). On the other hand, in a case where it is determined that the sheet feeding operation has not continued, that is, it is determined the sheet feeding operation has finished (No in S108), the monitoring by the lateral upper-surface sensors 31*a* and 31*b* is completed (S109), and the control of the sheet feeding operation is finished.

Here, the remaining quantity detector for the sheets counts the number of pulses of the lift motor 19 that is the lift 190 of the sheet stacker 11 from a certain start point. Then the remaining quantity detector for the sheets calculates the remaining sheet quantity on the sheet stacker 11 from the lift-up amount of the sheet stacker 11 per pulse.

As a result, as illustrated in FIG. 15A, when the sheet stacker 11 rises to a position where the air flow path is blocked, the detection position of the second lateral upper-surface sensor 31*b* becomes the non-detection region 205 of the detection surface 204, so that the second lateral upper-surface sensor 31*b* is rendered in non-detection. Thus, the sheet stacker 11 starts lifting.

Then, as illustrated in FIG. 15B, the sheet stacker 11 rises to a position where the floated sheets can rise to the attractable area E1 (experimental value obtained from evaluation). When such lift-up is made, the detection position of the second lateral upper-surface sensor 31*b* becomes the detection region 206 under the suede material 203 of the detection surface 204, so that the second lateral upper-surface sensor 31*b* is rendered in detection. Thus, the lift-up of the sheet stacker 11 is completed.

A lift-up start position (at which the sheet stacker 11 blocks the air flow path) and a lift-up end position (at which the floated sheets can float to the attractable area E1) in this control can be controlled with the sheet metal and the suede material 203 included in the sheet stacker 11. With this control, position control with higher accuracy than the position control by the remaining quantity detector can be performed.

In addition, in accordance with a combination of the detection state of the first lateral upper-surface sensor 31*a* and the detection state of the second lateral upper-surface sensor 31*b*, the control of the lift 190 that lifts up and down the sheet stacker 11 may be switched.

Normally, the lift-up of the sheet stacker 11 is performed by repeating lifting at a predetermined specified step rate until a predetermined condition is satisfied. That is, as the specified step rate increases, the amount at which the sheet stacker 11 can rise at a time increases, whereas the accuracy at the time of stopping deteriorates. By contrast, as the specified step rate decreases, the amount at which the sheet stacker 11 can rise at a time decreases, whereas the accuracy at the time of stopping improves.

Therefore, in the sheet feeding device 200 of the present embodiment, the specified step rate in control of the lift 190 (X1>X3>X2) can also be switched (selectively used), in accordance with a combination of the respective detection states of the lateral upper-surface sensors 31*a* and 31*b*.

With this switching, provided can be the sheet feeding device 200 capable of feeding the sheet S that has been floated effectively at an appropriate timing.

There are four combinations of the respective detection states of the lateral upper-surface sensors 31*a* and 31*b*, that is, combinations of "detection" and "non-detection" of the lateral upper-surface sensors 31*a* and 31*b*.

Here, Table 1 indicates examples of the combinations.

Table 1 indicates examples of control contents in accordance with a combination of the respective detection states of the lateral upper-surface sensors 31*a* and 31*b* and the specified step rates at the time of lift-up operation.

TABLE 1

| Combination 1 | Combination 2 | Combination 3 | Combination 4 |
|---|---|---|---|
| (Condition) First lateral upper-surface sensor: Dense sheets | (Condition) First lateral upper-surface sensor: Non-detection | (Condition) First lateral upper-surface sensor: Detection | (Condition) First lateral upper-surface sensor: Non-detection |

TABLE 1-continued

| Combination 1 | Combination 2 | Combination 3 | Combination 4 |
|---|---|---|---|
| detection<br>Second lateral upper-surface sensor: Sheet bundle detection | Second lateral upper-surface sensor: Detection | Second lateral upper-surface sensor: Non-detection | Second lateral upper-surface sensor: Non-detection |
| (Control Content)<br>Not perform lift-up operation | (Control content)<br>Lift up sheet stacker by step of X1 [mm] | (Control content)<br>Lift up sheet stacker by step of X2 [mm] | (Control content)<br>Lift up sheet stacker by step of X3 [mm] |

The condition of "combination 1" indicated in Table 1 includes that both of the first lateral upper-surface sensor 31*a* and the second lateral upper-surface sensor 31*b* are in "detection", the first lateral upper-surface sensor 31*a* has detected the floated sheets having a sufficient density (not in suspension), and the second lateral upper-surface sensor 31*b* has detected the sheet bundle. Thus, it is determined that urgent lift-up of the sheet stacker 11 is not required, and the lift-up operation of the sheet stacker 11 is not performed.

The condition of "combination 2" indicated in Table 1 includes that the first lateral upper-surface sensor 31*a* is in "non-detection" (=the floated sheets are sparse) and the second lateral upper-surface sensor 31*b* is in "detection". In this combination, the first lateral upper-surface sensor 31*a* is in non-detection while the floated sheets are sparse, and the second lateral upper-surface sensor 31*b* has detected the sheet bundle. Thus, a sheet is required to be supplied to the attractable area E1 as quickly as possible, and X1 [mm] with the largest step rate is applied.

In both of the conditions of "combination 3" and "combination 4" indicated in Table 1, the second lateral upper-surface sensor 31*b* is in "non-detection" and highly likely to have detected the non-detection region 205 (suede material 203) of the sheet stacker 11. Unlike "combination 3" in which the first lateral upper-surface sensor 31*a* is in "detection", particularly in "combination 4", the first lateral upper-surface sensor 31*a* is also in "non-detection" (=the floated sheets are sparse). Furthermore, the stop accuracy of the forceful-lift-up end position is required when the forceful lift-up is made, so that X2 or X3 [mm] with a lift-up amount finer than X1 [mm] is used for "combination 3" and "combination 4". Particularly in "Combination 4", while the stopping accuracy is required, furthermore, the first lateral upper-surface sensor 31*a* is also in non-detection (=the floated sheets are sparse) Thus, an intermediate step rate that satisfies with the following relationship: X1>X3>X2 and is supportable for both of the stopping accuracy and the lift-up speed, is applied.

As a result, in accordance with the density of floated sheets in a floating region and a semi-floating region and the position of the sheet stacker 11, the lift-up speed when the sheet stacker 11 is lifted up and the stopping accuracy when the stopping operation stops can be compatible with each other.

Although the present embodiment has been described with reference to the drawings, the specific configuration is not limited to the configuration including the sheet feeding device 200 of the present embodiment described above, and a change in design or the like may be made within a range without departing from the gist of the invention.

For example, in the present embodiment, the sheet feeding device 200 coupled to the electrophotographic image forming apparatus 100 has been described. However, the sheet feeding device 200 can be applied to an inkjet image forming apparatus to which a sheet feeding device is to be connected or in which a sheet feeding device to be incorporated.

In addition, an apparatus for the connection or the incorporation is not limited to an image forming apparatus. Thus, an apparatus that performs processing on a sheet such as a sheet folding apparatus that performs folding processing on a sheet or an apparatus that performs inspection processing on a sheet can be also applied to the apparatus.

Furthermore, the image forming system 1 including the image forming apparatus 100 and the sheet feeding device 200 has been described. However, as a system including a sheet feeding device, a sheet folding system including a sheet folding apparatus that performs folding processing on a sheet and a sheet feeding device can be also applied.

The sheet includes, paper, coated paper, label paper, an overhead projector (OHP) sheet, a film, a prepreg and the like.

Here, the prepreg is mainly used as a material of a laminated board or a multilayer printed wiring board. For example, the prepreg is a material manufactured through the following process. A long base material such as glass cloth, paper, nonwoven fabric, and aramid fiber cloth is impregnated with a resin varnish mainly containing a thermosetting resin such as an epoxy resin and a polyimide resin. The long base material is heated and dried, and then cut in to a sheet (sheet material).

The above description is merely an example, and specific effects are exerted for each of the following aspects.

Aspect A

A sheet feeding device, such as the sheet feeding device 200, includes: a blower, such as the front blower 12, that floats a sheet, such as the sheet S, of an upper portion of a sheet bundle such as the sheet bundle Sb; a conveyor, such as the attracting conveyance unit 20, that conveys the floated sheet; a lift, such as the lift 190, including, for example, the lift motor 19 that lifts up the sheet stacker, such as the sheet stacker 11, that stacks the sheet bundle; a first reflective optical sensor, such as the first lateral upper-surface sensor 31*a*, that detects the floated sheet; a second reflective optical sensor, such as the second lateral upper-surface sensor 31*b*, that detects the sheet bundle and a side face of, for example, the detection surface 204 of the sheet stacker; and circuitry, for example, the sheet controller 18 to control the lift based on a detection result of each reflective optical sensor. The side face of the sheet stacker includes a detection region, such as the detection region 206, and a non-detection region, such as the non-detection region 205. When the second reflective optical sensor changes from a detection state to a non-detection state, the circuitry causes the lift to lift up the sheet stacker.

Thus, the side surface of the sheet stacker includes the detection region and the non-detection region. Therefore, when the sheet stacker rises to a position where the air is difficult to blow to the floated sheet in the air flow path of the blower, the detection result of the second reflective optical sensor can be changed from detection to non-detection. That is, detection that the sheet stacker positions in the air flow path of the blower and the air is difficult to blow to the floated sheet can be made. Therefore, even in almost running out in which the sheet stacking face positions at a position above the detection range of the second reflective optical sensor, considering a case where the air easily blows to the floated sheet and a case where the air hardly blows to the floated sheet, control suitable for the configuration of the sheet feeding device can be performed.

Here, the following examples can be included as a case in which the lift-up step rate in lifting up the sheet stacker 11 is changed, based on a combination of the respective detection results of the reflective optical sensors, at the time of almost running out at which the sheet stacking face positions at the position above the detection range of the second reflective optical sensor.

When the second reflective optical sensor has detected the detection region of the sheet stacker, in a case where the first reflective optical sensor is in detection, nothing is done (stop), and in a case where the first reflective optical sensor is in non-detection, the sheet stacker is lifted up at the smallest lift-up step rate.

On the other hand, when the second reflective optical sensor has detected the non-detection region of the sheet stacker and is rendered in "non-detection", in a case where the first reflective optical sensor is in non-detection, the sheet stacker is lifted up at the intermediate lift-up step rate, and in a case where the first reflective optical sensor is in detection, the sheet stacker is lifted up by the largest lift-up step rate.

This control is adjustable depending on the range of the detection region and the non-detection region included in the sheet stacker. Thus, the control can switch at the position where the floating sheet is difficult to flow because the sheet stacker positions are in the air flow path of the blower and the air difficult to blow to the floating sheet.

Then, when it is detected that the air is difficult to blow to the floated sheet, in accordance with a combination of the respective detection results of the reflective optical sensors, the lift is controlled to cause the sheet stacker to rise. Thus, the floated sheet can be also more appropriately controlled than ever, to the attractable area, such as the attractable area E1.

Therefore, provided can be the sheet feeding device capable of reducing the occurrence of non-feeding of a sheet due to insufficient floating of the sheet at the time of almost running out of the sheet bundle on the sheet stacker.

Aspect B

In the sheet feeding device according to Aspect A, the circuitry, such as the sheet controller 18, that controls the lift, based on the detection result of each of the first reflective optical sensor and the second reflective optical sensor, such as detection/non-detection.

Thus, provided can be the sheet feeding device capable of feeding a sheet at an appropriate timing, even in a case where the sheet feeding device is coupled to an apparatus that is difficult to directly control the lift that causes the sheet stacker to lift.

Aspect C

In the sheet feeding device according to Aspect A or Aspect B, the circuitry switches between execution and non-execution of lift-up operation of the lift and changes a lift-up amount, such as the specified step rate X1, X2, or X3, of the sheet stacker, based on a combination, such as combination 1, 2, or 3, of the detection results of the first reflective optical sensor and the second reflective optical sensor, such as the detection/non-detection.

Thus, provided can be the sheet feeding device capable of feeding a sheet that has been effectively floated, at an appropriate timing.

Aspect D

In the sheet feeding device according to any of Aspect A to Aspect C, in a case where the first reflective optical sensor or the second reflective optical sensor is in non detection, the circuitry causes the lift to lift up the sheet stacker when the remaining quantity of the sheet bundle stacked on the sheet stacker becomes equal to or less than a certain threshold that is, for example, 5%.

Such a configuration can further enhance the effect of reducing occurrence of non-feeding of a sheet due to insufficient floating of the sheet at the time of almost running out of the sheet bundle on the sheet stacker.

Aspect E

In the sheet feeding device according to any of Aspect A to Aspect D, a reflection reducing material, such as the suede material 203, forming the non-detection region is disposed on the side face of the sheet stacker.

Such a configuration can enhance the accuracy of the position detection in the height direction (accuracy of lifting operation) of the sheet stacker, with the simple configuration.

Aspect F

In the sheet feeding device according to Aspect E, the reflection reducing material is a suede material, such as the suede material 203.

Such a configuration can inexpensively enhance the accuracy of the position detection in the height direction (accuracy of lifting operation) of the sheet stacker, with the simple configuration.

Aspect G

In the sheet feeding device according to any of Aspect A to Aspect F, the relationship of X1>X3>X2 is satisfied where X1 represents a specified step rate at which the sheet stacker is lift up when the first reflective optical sensor is in non detection and the second reflective optical sensor is in detection, X2 represents the specified step rate when the first reflective optical sensor is in detection and the second reflective optical sensor is in non detection, and X3 represents the specified step rate when the first reflective optical sensor is in non detection and the second reflective optical sensor is in non detection.

Such a configuration enables the lift-up speed at the time of lifting up the sheet stacker 11 and the stopping accuracy at the time of the stopping operation stops to be compatible with each other, in accordance with the state of the density of the floated sheet in the floating region and a semi-floating region and the position of the sheet stacker, such as the sheet stacker 11.

Aspect H

An image forming apparatus, such as the image forming apparatus 100, that forms an image on a sheet, such as the sheet 5, that has been separated and fed from the sheet bundle, such as the sheet bundle Sb, includes the sheet feeding device, such as the sheet feeding device 200, according to any of Aspect A to Aspect G, to separate and feed a sheet from the sheet bundle.

Thus, provided can be an image forming apparatus capable of exerting an effect similar to the effect of the sheet feeding device according to any of Aspect A to Aspect G.

Aspect I

An image forming system, such as the image forming system 1, includes an image forming apparatus, such as the image forming apparatus 100, and the sheet feeding device, such as the sheet feeding device 200, according to any of Aspect A to Aspect G to feed, to the image forming apparatus, a sheet, such as the sheet 5, that has been separated from the sheet bundle, such as the sheet bundle Sb.

Thus, provided can be an image forming system capable of exerting an effect similar to the effect of the sheet feeding device according to any of Aspect A to Aspect G.

Aspect J

A sheet processing apparatus, such as a sheet folding apparatus, that performs processing, such as folding processing, on the sheet, such as the sheet 5, that has been separated and fed from the sheet bundle, such as the sheet bundle Sb, includes the sheet feeding device, such as the sheet feeding device 200, according to any of Aspect A to Aspect G, to separate and feed a sheet from the sheet bundle.

Thus, provided can be a sheet processing apparatus capable of exerting an effect similar to the effect of the sheet feeding device according to any of Aspect A to Aspect G.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device comprising:

a sheet stacker configured to stack a sheet bundle;

a blower configured to float a sheet on an upper portion of the sheet bundle;

a conveyor configured to convey the sheet floated by the blower;

a lift configured to lift the sheet stacker up and down;

a first reflective optical sensor configured to detect the sheet floated by the blower;

a second reflective optical sensor configured to detect the sheet bundle and a side face of the sheet stacker, the side face of the sheet stacker including a detection region, to be detected by the second reflective optical sensor, and a non-detection region; and circuitry configured to control the lift based on a detection result of the first reflective optical sensor and a detection result of the second reflective optical sensor, the circuitry configured to cause the lift to lift the sheet stacker up in response to the detection result of the second reflective optical sensor indicating a change from a detection state to a non-detection state.

2. The sheet feeding device of claim 1, wherein the circuitry is configured to control the lift, based on a combination of the detection result of the first reflective optical sensor and the detection result of the second reflective optical sensor.

3. The sheet feeding device of claim 2, wherein the circuitry is configured to switch between execution and non-execution of lift-up operation of the lift and is configured to change a lift-up amount of the sheet stacker, based on a combination of the detection result of the first reflective optical sensor and the detection result of the second reflective optical sensor.

4. The sheet feeding device of claim 2, wherein upon the detection result of the first reflective optical sensor or the second reflective optical sensor indicating a non-detection state, the circuitry is configured to cause the lift to lift up the sheet stacker in response to a remaining quantity of the sheet bundle on the sheet stacker being equal to or less than a threshold.

5. The sheet feeding device of claim 2, wherein a reflection reducing material forms the non-detection region on the side face of the sheet stacker.

6. The sheet feeding device of claim 5, wherein the reflection reducing material is a suede material.

7. The sheet feeding device of claim 2, wherein a relationship of $X1>X3>X2$ is satisfied, where X1 represents a step rate at which the circuitry is configured to cause the lift to lift up the sheet stacker upon the detection result of the first reflective optical sensor indicating a non-detection state and upon the detection result of the second reflective optical sensor indicating a detection state, X2 represents the step rate upon the detection result of the first reflective optical sensor indicating a detection state and upon the detection result of the second reflective optical sensor indicating a non-detection state, and X3 represents the step rate upon the detection result of the first reflective optical sensor indicating a non-detection state and upon the detection result of the second reflective optical sensor indicating a non-detection state.

8. An image forming apparatus comprising:

the sheet feeding device of claim 2, configured to separate and feed a sheet from the sheet bundle; and an image forming device configured to form an image on the sheet.

9. An image forming system comprising:

the sheet feeding device of claim 2, configured to separate and feed a sheet from the sheet bundle; and an image forming apparatus configured to form an image on the sheet fed from the sheet feeding device.

10. The sheet feeding device of claim 1, wherein the circuitry is configured to switch between execution and non-execution of lift-up operation of the lift and is configured to change a lift-up amount of the sheet stacker, based on a combination of the detection result of the first reflective optical sensor and the detection result of the second reflective optical sensor.

11. The sheet feeding device of claim 1, wherein upon the detection result of the first reflective optical sensor or the second reflective optical sensor indicating a non-detection state, the circuitry is configured to cause the lift to lift up the sheet stacker in response to a remaining quantity of the sheet bundle on the sheet stacker being equal to or less than a threshold.

12. The sheet feeding device of claim 1, wherein a reflection reducing material forms the non-detection region on the side face of the sheet stacker.

13. The sheet feeding device of claim 12, wherein the reflection reducing material is a suede material.

14. An image forming apparatus comprising:

the sheet feeding device of claim 13, configured to separate and feed a sheet from the sheet bundle; and an image forming device configured to form an image on the sheet.

15. An image forming system comprising:

the sheet feeding device of claim 13, configured to separate and feed a sheet from the sheet bundle; and an image forming apparatus configured to form an image on the sheet fed from the sheet feeding device.

16. An image forming apparatus comprising:

the sheet feeding device of claim 12, configured to separate and feed a sheet from the sheet bundle; and an image forming device configured to form an image on the sheet.

17. An image forming system comprising:

the sheet feeding device of claim 12, configured to separate and feed a sheet from the sheet bundle; and an image forming apparatus configured to form an image on the sheet fed from the sheet feeding device.

18. The sheet feeding device of claim 1, wherein a relationship of X1>X3>X2 is satisfied, where X1 represents a step rate at which the circuitry is configured to cause the lift to lift up the sheet stacker upon the detection result of the first reflective optical sensor indicating a non-detection state and upon the detection result of the second reflective optical sensor indicating in a detection state, X2 represents the step rate upon the detection result of the first reflective optical sensor indicating a detection state upon the detection result of the second reflective optical sensor indicating a non-detection state, and X3 represents the step rate upon the detection result of the first reflective optical sensor indicating a non-detection state and upon the detection result of the second reflective optical sensor indicating a non-detection state.

19. An image forming apparatus comprising:

the sheet feeding device of claim 1, configured to separate and feed a sheet from the sheet bundle; and an image forming device configured to form an image on the sheet.

20. An image forming system comprising:

the sheet feeding device of claim 1, configured to separate and feed a sheet from the sheet bundle; and an image forming apparatus configured to form an image on the sheet fed from the sheet feeding device.

* * * * *